US011745504B2

(12) United States Patent
Fujisawa et al.

(10) Patent No.: US 11,745,504 B2
(45) Date of Patent: Sep. 5, 2023

(54) LIQUID DISCHARGING APPARATUS AND INTEGRATED CIRCUIT DEVICE

(71) Applicant: Seiko Epson Corporation, Tokyo (JP)

(72) Inventors: Kazuhito Fujisawa, Minowa (JP); Tomoko Hara, Chino (JP)

(73) Assignee: SEIKO EPSON CORPORATION

( * ) Notice: Subject to any disclaimer, the term of this patent is extended or adjusted under 35 U.S.C. 154(b) by 140 days.

(21) Appl. No.: 17/487,029

(22) Filed: Sep. 28, 2021

(65) Prior Publication Data

US 2022/0097368 A1 Mar. 31, 2022

(30) Foreign Application Priority Data

Sep. 30, 2020 (JP) ..... 2020-166261

(51) Int. Cl.
*B41J 29/38* (2006.01)
*B41J 2/045* (2006.01)

(52) U.S. Cl.
CPC ..... *B41J 2/04581* (2013.01); *B41J 2/04541* (2013.01); *B41J 2/04551* (2013.01)

(58) Field of Classification Search
CPC .... B41J 2002/14338; B41J 2002/14483; B41J 2/04581; B41J 2/04546
See application file for complete search history.

(56) References Cited

U.S. PATENT DOCUMENTS

| | | | | |
|---|---|---|---|---|
| 10,576,739 | B2 | 3/2020 | Yamada et al. | |
| 2005/0083359 | A1* | 4/2005 | Tamura | B41J 2/04593 347/10 |
| 2006/0082617 | A1* | 4/2006 | Nagashima | B41J 2/04573 347/68 |
| 2009/0189936 | A1* | 7/2009 | Tamura | B41J 2/04588 347/12 |
| 2014/0078224 | A1* | 3/2014 | Park | B41J 2/14233 347/71 |
| 2019/0009527 | A1 | 1/2019 | Yamada et al. | |
| 2019/0291419 | A1 | 9/2019 | Yamada et al. | |
| 2020/0171818 | A1 | 6/2020 | Chikamoto | |

FOREIGN PATENT DOCUMENTS

| | | | |
|---|---|---|---|
| CN | 108472949 | A | 8/2018 |
| EP | 3695969 | A1 | 8/2020 |
| JP | 2019-166767 | A | 10/2019 |

* cited by examiner

*Primary Examiner* — Lam S Nguyen
(74) *Attorney, Agent, or Firm* — Harness, Dickey & Pierce, P.L.C.

(57) ABSTRACT

A liquid discharging apparatus has a switch control circuit that controls whether to cause each of a first switch circuit, a second switch circuit, a third switch circuit, and a fourth switch circuit to output a driving signal. The switch control circuit has a fifth switch circuit, a sixth switch circuit, and a seventh switch circuit. The fifth switch circuit switches between output of the first data to the second switch circuit and output of the second data to the second switch circuit. The sixth switch circuit switches between output of the first data to the third switch circuit and output of the third data to the third switch circuit. The seventh switch circuit switches between output of the first data to the fourth switch circuit and output of the fourth data to the fourth switch circuit.

5 Claims, 7 Drawing Sheets

LIQUID DISCHARGING APPARATUS AND INTEGRATED CIRCUIT DEVICE

The present application is based on, and claims priority from JP Application Serial Number 2020-166261, filed Sep. 30, 2020, the disclosure of which is hereby incorporated by reference herein in its entirety.

BACKGROUND

1. Technical Field

The present disclosure relates to a liquid discharging apparatus and an integrated circuit device.

2. Related Art

Known liquid discharging apparatuses that discharge a liquid to a medium are structured so that internal pressure in a cavity filled with the liquid is changed by driving a driving element in response to a driving signal and the liquid is then discharged due to the change in the internal pressure. Some of these known discharging apparatuses that discharge a liquid by driving a driving element to change internal pressure in a cavity are designed to discharge a highly viscous liquid or have a function to circulate liquid supplied to a discharge head. To stably discharge a liquid or stably circulate a liquid, a known liquid discharging apparatus of this type has a plurality of driving elements for a single nozzle from which the liquid is discharged; when the plurality of driving elements are driven, the liquid is discharged.

JP-A-2019-166767, for example, discloses a liquid discharging apparatus that discharges an ink by driving a piezoelectric element used as a driving element to change internal pressure in a cavity. A driving integrated circuit (IC) chip, in the liquid discharging apparatus, that selectively applies a driving signal to a piezoelectric element has a switch that supplies a driving signal to its relevant piezoelectric element and a switch that supplies a driving signal to a piezoelectric element adjacent to the relevant piezoelectric element.

However, the liquid discharging apparatus described in JP-A-2019-166767 is not enough and is susceptible to improvement from the viewpoint of raising the transport speed of a signal to meet a recent growing demand for high-speed liquid discharging and of enhancing the versatility of a semiconductor device.

SUMMARY

A liquid discharging apparatus according to one aspect of the present disclosure has: a driving signal output circuit that outputs a driving signal; a discharge control signal output circuit that outputs a discharge control signal including first data, second data, third data, and fourth data; and a liquid discharge head that discharges a liquid in response to the driving signal and the discharge control signal. The liquid discharge head has: a first driving element, a second driving element, a third driving element, and a fourth driving element that are driven by the driving signal; and an integrated circuit that controls supply of the driving signal to the first driving element, to the second driving element, to the third driving element, and to the fourth driving element according to the discharge control signal. The integrated circuit has: a first switch circuit that receives the driving signal and switches between output and non-output of the driving signal to the first driving element; a second switch circuit that receives the driving signal and switches between output and non-output of the driving signal to the second driving element; a third switch circuit that receives the driving signal and switches between output and non-output of the driving signal to the third driving element; a fourth switch circuit that receives the driving signal and switches between output and non-output of the driving signal to the fourth driving element; and a switch control circuit that receives the discharge control signal and controls whether to cause each of the first switch circuit, the second switch circuit, the third switch circuit, and the fourth switch circuit to output the driving signal. The switch control circuit has: a fifth switch circuit that receives the first data and the second data; a sixth switch circuit that receives the first data and the third data; and a seventh switch circuit that receives the first data and the fourth data. The fifth switch circuit switches between output of the first data to the second switch circuit and output of the second data to the second switch circuit. The sixth switch circuit switches between output of the first data to the third switch circuit and output of the third data to the third switch circuit. The seventh switch circuit switches between output of the first data to the fourth switch circuit and output of the fourth data to the fourth switch circuit.

An integrated circuit device according to one aspect of the present disclosure is provided in a liquid discharge head that has a first driving element, a second driving element, a third driving element, and a fourth driving element; the integrated circuit device has: a first switch circuit that receives a driving signal and switches between output and non-output of the driving signal to the first driving element; a second switch circuit that receives the driving signal and switches between output and non-output of the driving signal to the second driving element; a third switch circuit that receives the driving signal and switches between output and non-output of the driving signal to the third driving element; a fourth switch circuit that receives the driving signal and switches between output and non-output of the driving signal to the fourth driving element; and a switch control circuit that receives a discharge control signal and controls whether to cause each of the first switch circuit, the second switch circuit, the third switch circuit, and the fourth switch circuit to output the driving signal. The switch control circuit has: a fifth switch circuit that receives the first data and the second data; a sixth switch circuit that receives the first data and the third data; and a seventh switch circuit that receives the first data and the fourth data. The fifth switch circuit switches between output of the first data to the second switch circuit and output of the second data to the second switch circuit. The sixth switch circuit switches between output of the first data to the third switch circuit and output of the third data to the third switch circuit. The seventh switch circuit switches between output of the first data to the fourth switch circuit and output of the fourth data to the fourth switch circuit.

DESCRIPTION OF EXEMPLARY EMBODIMENTS

A preferred embodiment of the present disclosure will be described below with reference to the drawings. These drawings will be referenced for convenience of explanation. The embodiment described below does not unreasonably restrict the contents of the present disclosure, the contents being described in the scope of claims. All of the structures described below are not always essential structural requirements.

1. Outline of a Liquid Discharging Apparatus

Figure 1:
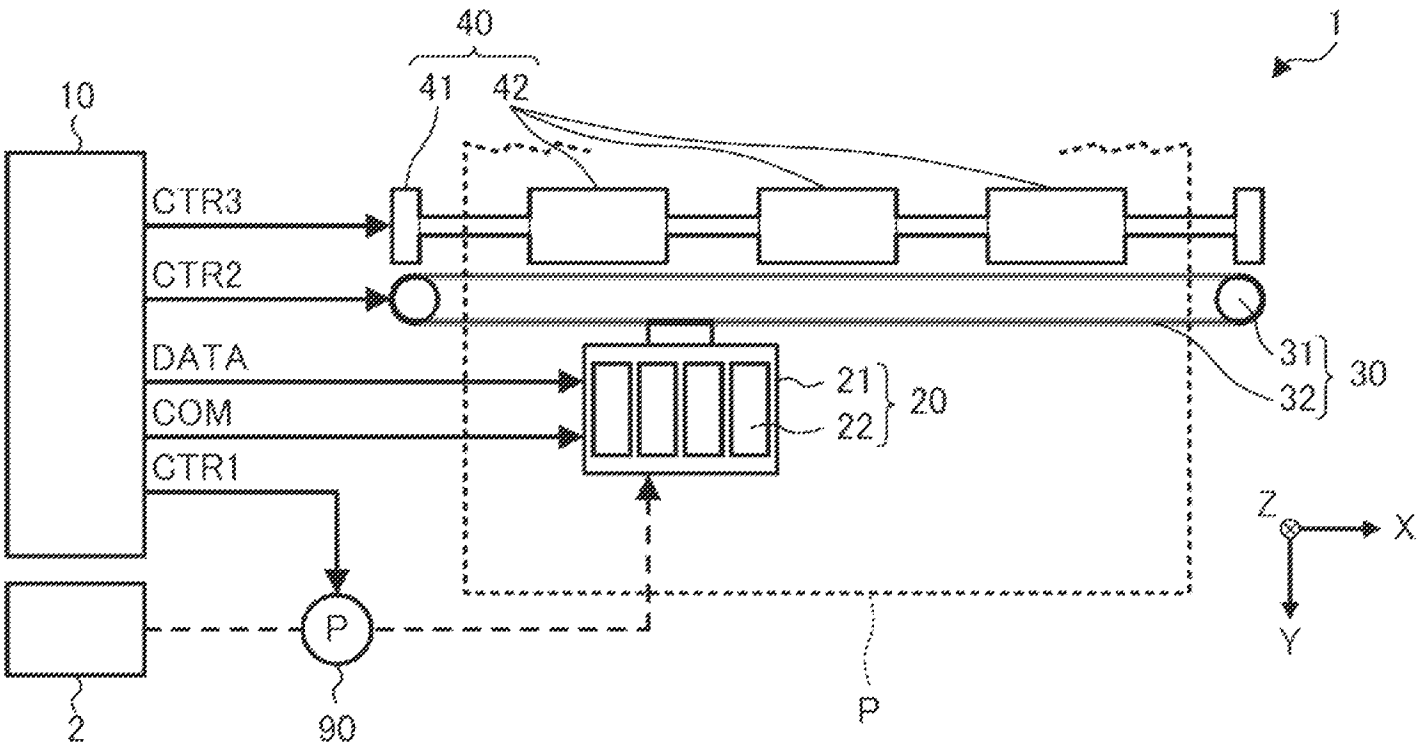
FIG. 1 schematically illustrates the structure of a liquid discharging apparatus.

FIG. 1 schematically illustrates the structure of a liquid discharging apparatus 1. The liquid discharging apparatus 1 in this embodiment is a serial printing type of ink jet printer. In the liquid discharging apparatus 1, to form a desired image on a medium P, while a carriage 21 in which liquid discharge heads 22 that discharge ink, which is an example of a liquid, are mounted are bidirectionally moved, the liquid discharge heads 22 discharge ink to the medium P. In the description below, a direction in which the carriage 21 moves will be taken as the X direction, a direction in which the medium P is transported will be taken as the Y direction, and a direction in which ink is discharged will be taken as the Z direction. Although the X direction, Y direction, and Z direction will be assumed to be mutually orthogonal, this does not restrict constituent elements included in the liquid discharging apparatus 1 to placement in which they are orthogonally provided. A direction along the X direction in which the carriage 21, in which the liquid discharge heads 22 that discharge a liquid are mounted, bidirectionally move will also be referred to as the main scanning direction. A direction along the Y direction in which the medium P is transported will also be referred to as the transport direction. A direction along the Z direction in which the liquid discharge heads 22 discharge ink will also be referred to as the discharge direction.

In the description below, the same side as the starting point of the arrow indicating the X direction will also be referred to as the −X-direction side, and the same side as the top of the arrow will also be referred to as the +X-direction side; the same side as the starting point of the arrow indicating the Y direction will also be referred to as the −Y-direction side, and the same side as the top of the arrow will also be referred to as the +Y-direction side; and the same side as the starting point of the arrow indicating the Z direction will also be referred to as the −Z-direction side, and the same side as the top of the arrow will also be referred to as the +Z-direction side.

As illustrated in FIG. 1, the liquid discharging apparatus 1 has an ink tank 2, a control unit 10, a head unit 20, a moving unit 30, a transport unit 40, and a circulation mechanism 90.

A plurality of types of ink to be discharged to the medium P are held in the ink tank 2. Colors of ink held in the ink tank 2 include black, cyan, magenta, yellow, red, gray, and the like. Examples of the ink tank 2 in which these types of ink are held include an ink cartridge, a bag-shaped ink pack formed from a flexible film, an ink tank that can be replenished with ink, and the like.

The circulation mechanism 90 supplies ink held in the ink tank 2 to the liquid discharge head 22 in response to a control signal CTR1 output from the control unit 10. The circulation mechanism 90 also collects ink held in ejection flow paths formed in the liquid discharge head 22 in response to the control signal CTR1 output from the control unit 10. That is, the circulation mechanism 90 causes ink to flow back in the liquid discharging apparatus 1.

The control unit 10 includes, for example, a processing circuit such as a central processing unit (CPU) or a field programmable gate array (FPGA) and a storage circuit such as a semiconductor memory. The control unit 10 controls elements in the liquid discharging apparatus 1.

The head unit 20 includes the carriage 21 and liquid discharge heads 22. The liquid discharge heads 22 are mounted in the carriage 21. The carriage 21 is fixed to an endless belt 32 included in the moving unit 30 described later. Each liquid discharge head 22 receives, from the control unit 10, discharge data signals DATA, which control discharging of ink, and a driving signal COM that drives the liquid discharge head 22 so that ink is discharged from it. The liquid discharge head 22 discharges, to the medium P, ink supplied from the ink tank 2 through the circulation mechanism 90, in response to the discharge data signals DATA and driving signal COM.

The moving unit 30 includes a carriage motor 31 and the endless belt 32. The carriage motor 31 operates in response to a control signal CTR2 entered from the control unit 10. The endless belt 32 rotates according to the operation of the carriage motor 31. Thus, the carriage 21 fixed to the endless belt 32 bidirectionally moves along the X direction.

The transport unit 40 includes a transport motor 41 and a transport roller 42. The transport motor 41 operates in response to a control signal CTR3 entered from the control unit 10. The transport roller 42 rotates according to the operation of the transport motor 41. The medium P is transported along the Y direction due to the rotation of the transport roller 42.

As described above, in the liquid discharging apparatus 1, ink is discharged from the liquid discharge head 22 mounted in the carriage 21 in response to the transport of the medium P by the transport unit 40 and to the bidirectional movement of the carriage 21 by the moving unit 30, so ink lands on predetermined positions on the medium P, forming a desired image on the medium P.

Figure 2:
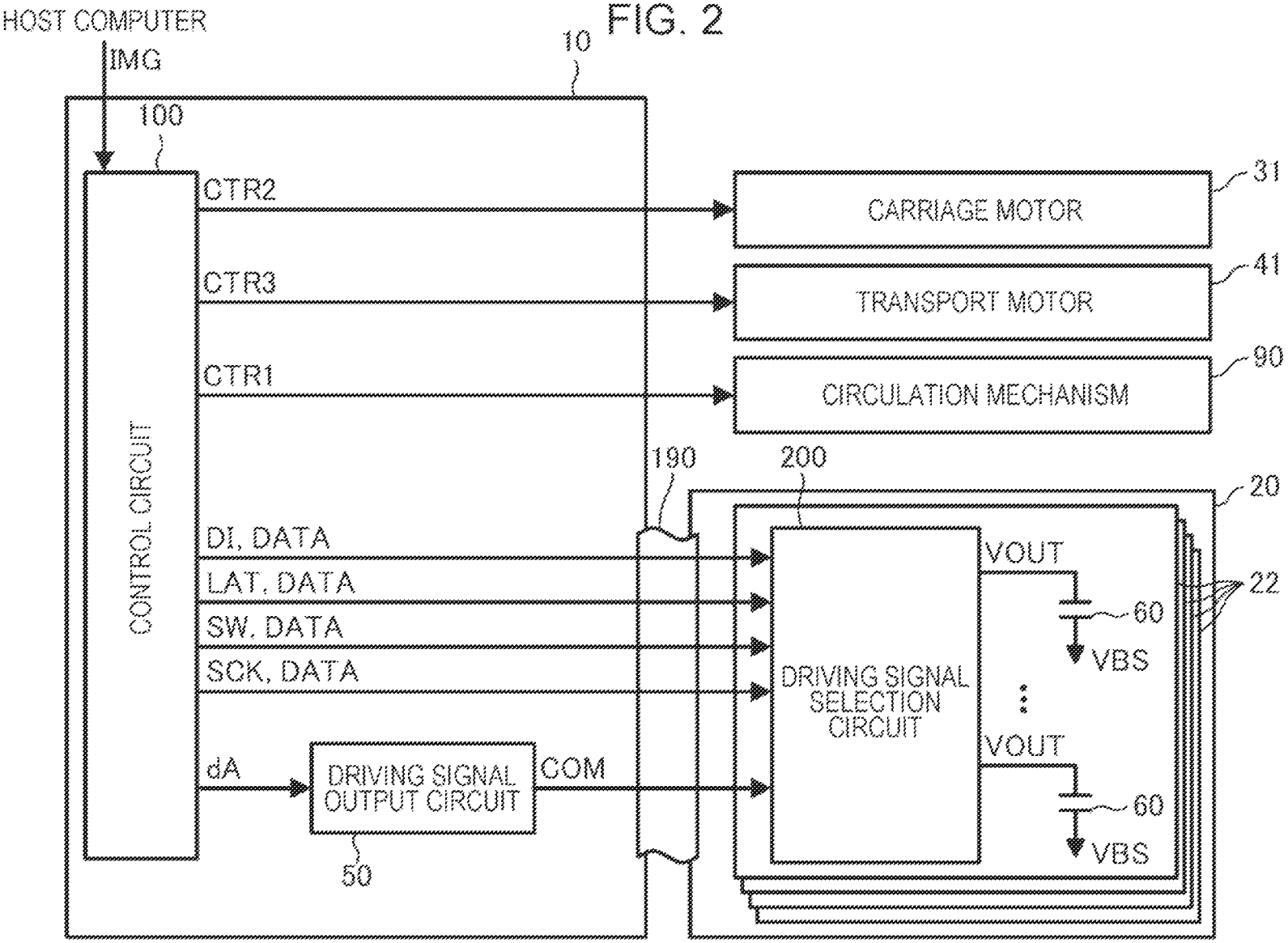
FIG. 2 is a functional block diagram illustrating the structure of the liquid discharging apparatus.

FIG. 2 is a functional block diagram illustrating the structure of the liquid discharging apparatus 1. As illustrated in FIG. 2, the liquid discharging apparatus 1 has the control unit 10 and head unit 20. The control unit 10 and head unit 20 are electrically coupled to each other through a cable 190, such as a flexible flat cable, that is easy to slide.

The control unit 10 has a control circuit 100 and a driving signal output circuit 50.

The control circuit 100 receives an image information signal IMG that includes information about an image to be formed on the medium P, the image information signal IMG being output from an external device such as a host computer. According to the image information signal IMG, the control circuit 100 outputs, to the head unit 20, a discharge control signal DI, a latch signal LAT, a switching signal SW, and a clock signal SCK as discharge data signals DATA, which control individual sections in the liquid discharging apparatus 1.

Specifically, the control circuit 100 creates the control signal CTR1 and outputs it to the circulation mechanism 90. The circulation mechanism 90 receives the control signal CTR1, after which in response to it, the circulation mechanism 90 supplies ink held in the ink tank 2 to the liquid discharge head 22 and collects ink held in the ejection flow paths in the liquid discharge head 22. The control circuit 100 also creates the control signal CTR2 and outputs it to the carriage motor 31. Thus, the carriage motor 31 is driven. The control circuit 100 also creates the control signal CTR3 and outputs it to the transport motor 41. Thus, the bidirectional movement of the carriage 21 along the X direction and the transport of the medium P along the Y direction are controlled. The control signals CTR1, CTR2, and CTR3 may be entered into the relevant elements through a driver circuit (not illustrated).

The control circuit 100 also creates a base driving signal dA and outputs it to the driving signal output circuit 50. The driving signal output circuit 50 receives the base driving signal dA, creates the driving signal COM from the base driving signal dA, and outputs the driving signal COM to the head unit 20. Specifically, the driving signal output circuit 50 converts the base driving signal dA that the driving signal output circuit 50 has received from digital to analog, performs class-D amplification on the converted analog signal to create the driving signal COM, and then outputs it to the head unit 20.

The head unit 20 has a plurality of liquid discharge heads 22, each of which has a driving signal selection circuit 200 and a plurality of piezoelectric elements 60. The driving signal selection circuit 200 receives the discharge control signal DI, latch signal LAT, switching signal SW, and clock signal SCK output from the control circuit 100, and also receives the driving signal COM output from the driving signal output circuit 50. The driving signal selection circuit 200 switches between supply and non-supply of the driving signal COM to the piezoelectric element 60, in response to the discharge control signal DI, latch signal LAT, switching signal SW, and clock signal SCK that the driving signal selection circuit 200 has received. In the description below, a signal output from the driving signal selection circuit 200, the signal being created as a result of switching between supply and non-supply of the driving signal COM to the piezoelectric element 60, will be referred to below as a driving signal VOUT. The structure and operation of the driving signal selection circuit 200 will be described later in detail.

The driving signal VOUT output from the driving signal selection circuit 200 is supplied to one end of the piezoelectric element 60. A reference voltage signal VBS, which is a reference potential in the driving of the piezoelectric element 60, is supplied to another end of the piezoelectric element 60. The piezoelectric element 60 is driven according to the difference in potential between the driving signal VOUT and the reference voltage signal VBS. The reference voltage signal VBS supplied to the other end of the piezoelectric element 60 is a signal having a direct-current (DC) voltage signal that is a reference in the driving of the piezoelectric element 60. For example, the reference voltage signal VBS may be a signal having a certain potential such as a DC voltage of 5.5 V or 6 V, or may be a signal at a ground potential.

The driving signal COM is an example of a driving signal output from the driving signal output circuit 50. Since the driving signal VOUT is created as a result of switching between supply and non-supply of the driving signal COM to the piezoelectric element 60, it can be said that the driving signal VOUT is also an example of a driving signal output from the driving signal output circuit 50.

2. Structure of the Liquid Discharge Head

Figure 3:
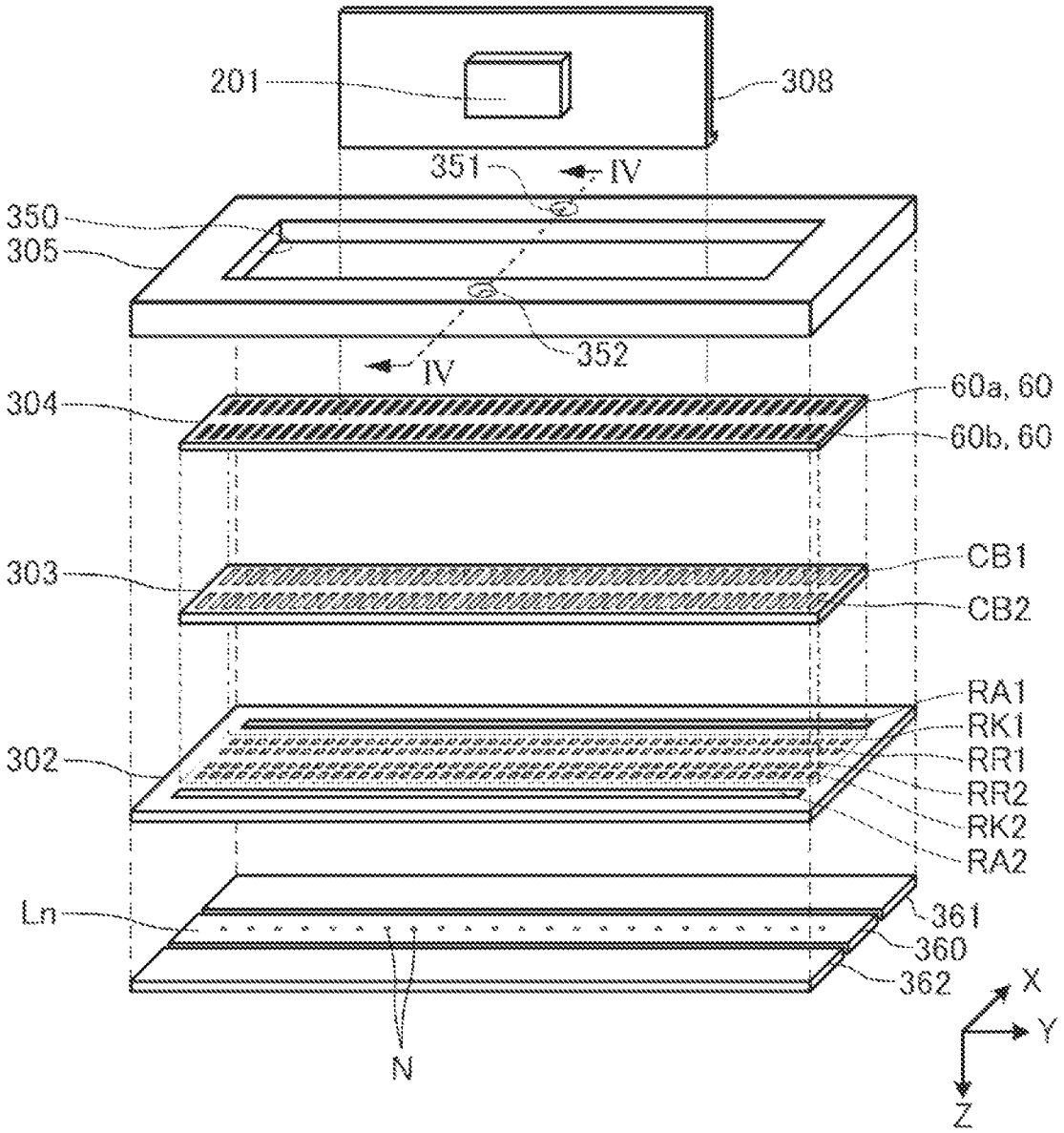
FIG. 3 is an exploded perspective view of a liquid discharge head.
Figure 4:
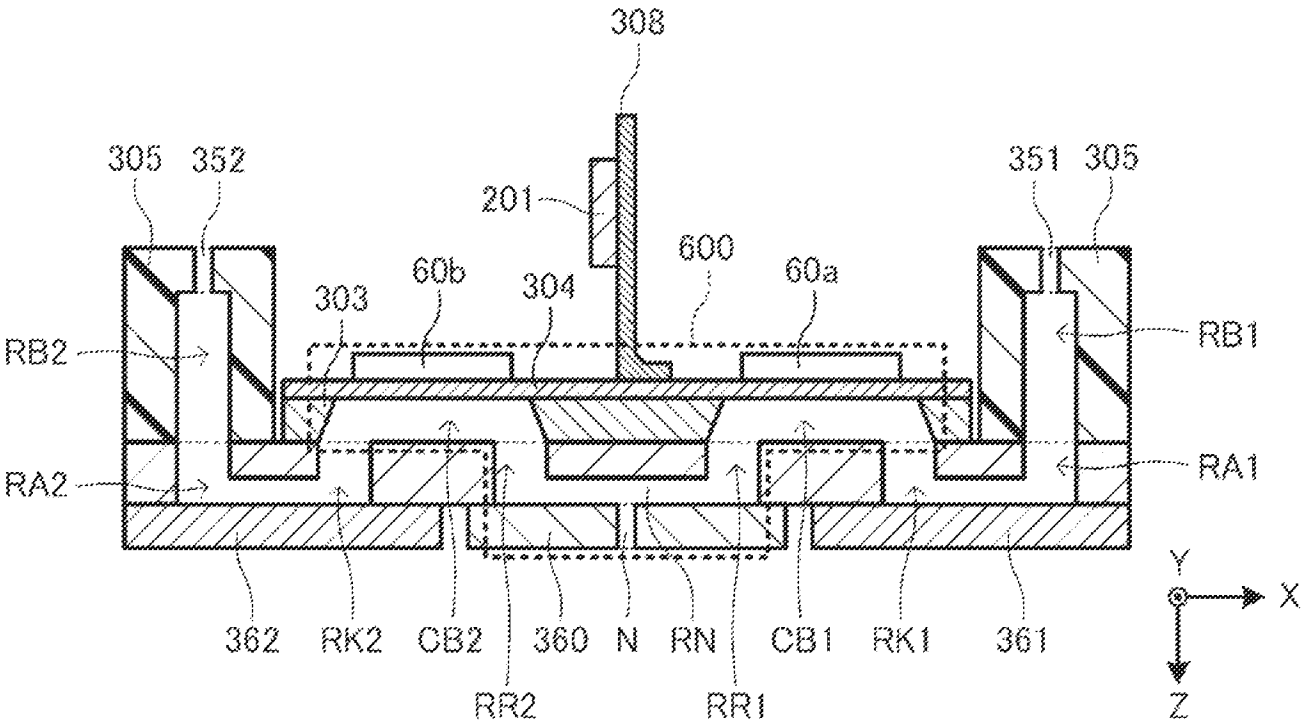
FIG. 4 is a sectional view taken along line IV-IV in FIG. 3.

Next, the structure of the liquid discharge head 22 in which the driving signal selection circuit 200 is provided will be described. FIG. 3 is an exploded perspective view of the liquid discharge head 22. FIG. 4 is a sectional view taken along line IV-IV in FIG. 3.

As illustrated in FIGS. 3 and 4, the liquid discharge head 22 has a nozzle substrate 360, compliance sheets 361 and 362, a communication plate 302, a pressure chamber substrate 303, a vibration plate 304, a holding chamber forming substrate 305, and a wiring board 308.

The nozzle substrate 360 is a plate-like member that is elongated in the Y direction and extends substantially parallel to an XY plane. M nozzles N are formed in the nozzle substrate 360. Each nozzle N is a through-hole formed in the nozzle substrate 360. In the nozzle substrate 360, the M nozzles N are arranged side by side along the Y direction. In the description below, a row of nozzles N arranged side by side along the Y direction will also be referred to as a nozzle row Ln. Here, the term "substantially parallel" indicates not only that the nozzle substrate 360 is completely parallel to an XY plane but also that when error is taken into consideration, the nozzle substrate 360 can be regarded to be parallel to an XY plane.

The communication plate 302 is positioned on the −Z side of the nozzle substrate 360. The communication plate 302 is a plate-like member that is elongated in the Y direction and extends substantially parallel to an XY plane. In the communication plate 302, ink flow paths are formed.

Specifically, a supply flow path RA1 and an ejection flow path RA2 are formed in the communication plate 302. The supply flow path RA1 is positioned on the +X side of the communication plate 302 and extends along the Y direction. The ejection flow path RA2 is positioned on the −X side of the communication plate 302 and extends along the Y direction.

The communication plate 302 internally has 2M coupling flow paths RK1, 2M coupling flow paths RK2, 2M communication flow paths RR1, 2M communication flow paths RR2, and M nozzle flow paths RN having a one-to-one correspondence with the M nozzles N.

The M coupling flow paths RK1 are arranged side by side along the Y direction on the −X side of the supply flow path RA1. The M communication flow paths RR1 are arranged side by side along the Y direction on the −X side of the M coupling flow paths RK1 arranged side by side along the Y direction. The M coupling flow paths RK2 are arranged side by side along the Y direction on the +X side of the ejection flow path RA2 and on the −X side of the M communication flow paths RR1 arranged side by side along the Y direction. The M communication flow paths RR2 are arranged side by side along the Y direction on the +X side of the M coupling flow paths RK2 arranged side by side along the Y direction and on the −X side of the M communication flow paths RR1 arranged side by side along the Y direction. The nozzle flow path RN causes two communication flow paths RR1 and two communication flow paths RR2 that correspond to the same nozzle N to communicate with each other. When the communication plate 302 is viewed from the Z direction, the nozzle N is positioned at a substantially central position of the nozzle flow path RN in the X direction. Here, the term "substantially central position" indicates not only that the nozzle flow path RN is positioned strictly at the central position but also that when error is taken into consideration, the nozzle flow path RN can be regarded to be positioned at the central position.

Now, the shape of the nozzle flow path RN formed in the communication plate 302 will be described with reference to FIG. 5.

Figure 5:
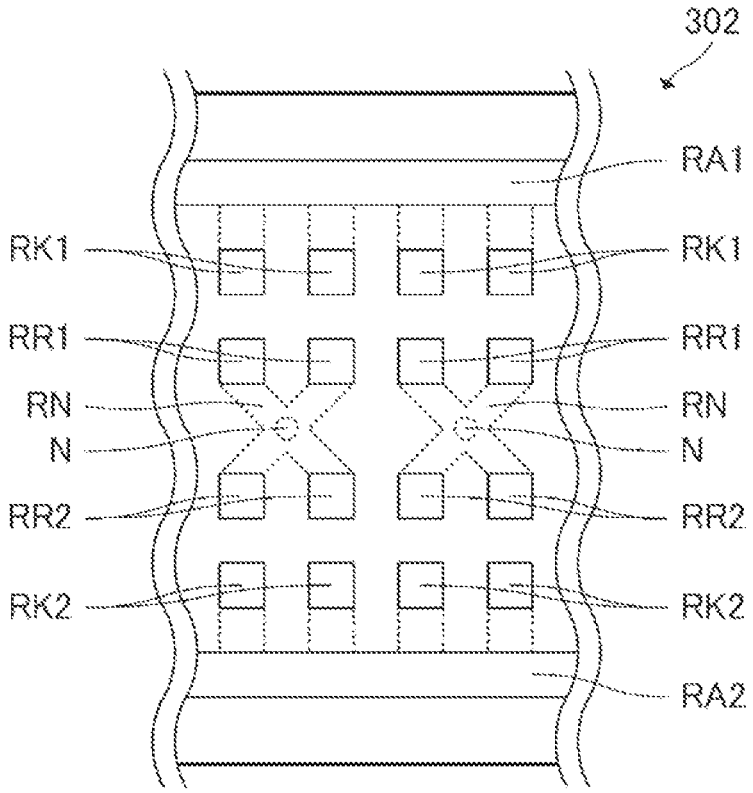
FIG. 5 illustrates an example of the shape of a nozzle flow path formed in a communication plate.

FIG. 5 illustrates an example of the shape of the nozzle flow path RN formed in the communication plate 302. The nozzle flow path RN causes two communication flow paths RR1 and two communication flow paths RR2 to communicate with each other, as illustrated in FIG. 5. Specifically, the nozzle flow path RN causes one of the two communication flow paths RR1 and one of the two communication flow paths RR2 to communicate with each other, and also causes the other of the two communication flow paths RR1 and the other of the two communication flow paths RR2 to communicate with each other. The nozzle flow path RN is formed so that one part of the nozzle flow path RN that causes the one of the two communication flow paths RR1 and the one of the two communication flow paths RR2 to communicate with each other and another part of the nozzle flow path RN that causes the other of the two communication flow paths RR1 and the other of the two communication flow paths RR2 to communicate with each other cross each other in the communication plate 302. The nozzle N is positioned at a position at which the one part of the nozzle flow path RN that causes the one of the two communication flow paths RR1 and the one of the two communication flow paths RR2 to communicate with each other and the other part of the nozzle flow path RN that causes the other of the two communication flow paths RR1 and the other of the two communication flow paths RR2 to communicate with each other cross each other.

Referring again to FIGS. 3 and 4, the pressure chamber substrate 303 is positioned on the −Z side of the communication plate 302. The pressure chamber substrate 303 is a plate-like member that is elongated in the Y direction and extends substantially parallel to an XY plane. In the pressure chamber substrate 303, ink flow paths are formed.

Specifically, in the pressure chamber substrate 303, 2M pressure chambers CB1 and 2M chambers CB2 are formed so as to be arranged side by side in the Y-axis direction. The pressure chamber CB1 causes the coupling flow path RK1 and communication flow path RR1 that correspond to the same nozzle N to communicate with each other. More specifically, when the pressure chamber CB1 is viewed from the Z direction, the coupling flow path RK1 and the end of the pressure chamber CB1 on the +X side communicate with each other, and the communication flow path RR1 and the end of the pressure chamber CB1 on the −X side communicate with each other, so the coupling flow path RK1 and communication flow path RR1 that correspond to the same nozzle N communicate with each other through the pressure chamber CB1. Similarly, the pressure chamber CB2 causes the coupling flow path RK2 and communication flow path RR2 that correspond to the same nozzle N to communicate with each other. More specifically, when the pressure chamber CB2 is viewed from the Z direction, the coupling flow path RK2 and the end of the pressure chamber CB2 on the −X side communicate with each other, and the communication flow path RR2 and the end of the pressure chamber CB2 on the +X side communicate with each other, so the coupling flow path RK2 and communication flow path RR2 that correspond to the same nozzle N communicate with each other through the pressure chamber CB2. Therefore, two pressure chambers CB1 and two pressure chambers CB2 communicate with each other for a single nozzle N.

The vibration plate 304 is positioned on the −Z side of the pressure chamber substrate 303. The vibration plate 304 is a plate-like member that is elongated in the Y direction and extends substantially parallel to an XY plane. The vibration plate 304 can elastically vibrate.

On the −Z side of the vibration plate 304, M piezoelectric elements 60*a* and M piezoelectric elements 60*b* are arranged side by side along the Y direction. The M piezoelectric elements 60*a*, which are part of the plurality of piezoelectric elements 60 included in the liquid discharge head 22, are in one-to-one correspondence with the M pressure chambers CB1. The M piezoelectric elements 60*b*, which are also part of the plurality of piezoelectric elements 60 included in the liquid discharge head 22, are in one-to-one correspondence with the M chambers CB2. That is, 4M piezoelectric elements 60 are arranged side by side in two rows on the −Z side of the vibration plate 304.

The piezoelectric elements 60*a* and 60*b* are driven according to a change in the potential of the supplied driving signal VOUT. The vibration plate 304 is displaced in response to the driving of the piezoelectric elements 60*a* and 60*b*. As a result, the internal pressure in the pressure chambers CB1 and CB2 changes. When the internal pressure in the pressure chambers CB1 and CB2 changes, ink filled in the pressure chambers CB1 and CB2 respectively passes through the communication flow paths RR1 and RR2, passes through the nozzle flow path RN, and is then discharged from the nozzle N.

The wiring board 308 is coupled to the surface of the vibration plate 304 on the −Z side. The wiring board 308 propagates various signals including the discharge data signals DATA and driving signal COM to the interior of the liquid discharge head 22. A flexible printed circuit (FPC) or another board having a flexible structure is used as this type of wiring board 308. An integrated circuit 201 is mounted on the wiring board 308 by a chip-on-film (COF) method. The driving signal selection circuit 200 described above is mounted in this integrated circuit 201. That is, the wiring board 308 propagates various signals including the discharge data signals DATA and driving signal COM to the integrated circuit 201 and also propagates the driving signal VOUT output from the driving signal selection circuit 200 included in the integrated circuit 201 to the relevant piezoelectric elements 60. The integrated circuit 201 in which this driving signal selection circuit 200 is mounted is an example of an integrated circuit device.

The holding chamber forming substrate 305 is positioned on the −Z side of the communication plate 302. The holding chamber forming substrate 305 is a member that is elongated in the Y and in which ink flow paths are formed.

Specifically, a supply flow path RB1 and an ejection flow path RB2 are formed in the holding chamber forming substrate 305. The supply flow path RB1 communicates with the supply flow path RA1. The ejection flow path RB2 communicates with the ejection flow path RA2. In addition, the holding chamber forming substrate 305 has an inlet 351 communicating with the supply flow path RB1 and an outlet 352 communicating with the ejection flow path RB2. Ink is supplied from the ink tank 2 to the inlet 351. Thus, ink is supplied from the ink tank 2 through the inlet 351 into the supply flow path RB1. Ink held in the ejection flow path RB2 is collected through the outlet 352. Ink collected through the outlet 352 is returned to the ink tank 2. An opening 350 is formed in the holding chamber forming substrate 305. The pressure chamber substrate 303, vibration plate 304, and wiring board 308 are disposed inside the opening 350.

This type of holding chamber forming substrate 305 is formed by, for example, being injection-molded with a resin material.

The holding chamber forming substrate 305 may be manufactured by using any known material and any known manufacturing method.

In the liquid discharge head 22 structured as described above, ink supplied from the ink tank 2 to the inlet 351 passes through the supply flow path RB1 and flows into the supply flow path RA1. After having flowed into the supply flow path RA1, ink branches into two coupling flow paths RK1 for each nozzle N and enters the two relevant pressure chambers CB1. Part of ink that has flowed into the pressure chambers CB1 passes through the two communication flow paths RR1, nozzle flow path RN, and two communication flow paths RR2, and then flows into the two pressure chambers CB2. Part of ink that has flowed into the pressure chambers CB2 passes through the two coupling flow paths RK2, ejection flow path RA2, and ejection flow path RB2, and is then ejected from the outlet 352.

When the piezoelectric element 60*a* is driven by the driving signal VOUT based on the driving signal COM, part of ink filled in the pressure chamber CB1 passes through the communication flow path RR1 and nozzle flow path RN and is then discharged from the nozzle N. When the piezoelectric elements 60*b* is driven by the driving signal VOUT based on the driving signal COM, part of ink filled in the pressure chamber CB2 passes through the communication flow path RR2 and nozzle flow path RN and is then discharged from the nozzle N.

The compliance sheet 361, which is positioned on the +Z side of the communication plate 302, closes the supply flow path RA1 and coupling flow path RK1 formed in the communication plate 302. This compliance sheet 361 is formed by including an elastic material. When variations in the pressure of ink occur in the supply flow path RA1 and coupling flow path RK1, the compliance sheet 361 eliminates these variations. Similarly, the compliance sheet 362, which is positioned on the +Z side of the communication plate 302, closes the ejection flow path RA2 and coupling flow path RK2 formed in the communication plate 302. This compliance sheet 362 is formed by including an elastic material. When variations in the pressure of ink occur in the ejection flow path RA2 and coupling flow path RK2, the compliance sheet 362 eliminates these variations.

As described above, the liquid discharge head 22 included in the liquid discharging apparatus 1 according to this embodiment has: pressure chambers CB1, in which pressure in each two pressure chambers CB1 changes due to the driving of two piezoelectric elements 60*a* corresponding to the two pressure chambers CB1; pressure chambers CB2, in which pressure in each two pressure chambers CB2 changes due to the driving of two piezoelectric elements 60*b* corresponding to the two pressure chambers CB2; and nozzles N, each of which communicates with the two relevant pressure chambers CB1 and two relevant pressure chambers CB2 and discharges ink. Thus, ink supplied into the liquid discharge head 22 can be led from the supply flow path RA1 to the ejection flow path RA2, circulating ink in the liquid discharge head 22. As a result, the risk is reduced that ink held in the liquid discharge head 22 suffers from a change in viscosity or another property.

The liquid discharge head 22 according to this embodiment can discharge, from each nozzle N, ink filled in two pressure chambers CB1 and ink filled in two pressure chambers CB2 by using four piezoelectric elements 60, two piezoelectric elements 60*a* and two piezoelectric elements 60*b*. Therefore, a driving capacity can be made higher than when ink filled in a single pressure chamber is discharged from the nozzle N by using a single piezoelectric element 60. As a result, a more amount of ink can be discharged from the nozzle N, and even when highly viscous ink is used, a stable discharge property can be assured.

In the description below, a structure including two piezoelectric elements 60*a*, two piezoelectric elements 60*b*, two pressure chambers CB1, two pressure chambers CB2, two communication flow paths RR1, two communication flow paths RR2, and a nozzle N will also be referred to as a discharge section 600 that discharges ink from the nozzle N by driving four piezoelectric elements 60.

3. Example of a Driving Signal Waveform

Figure 6:
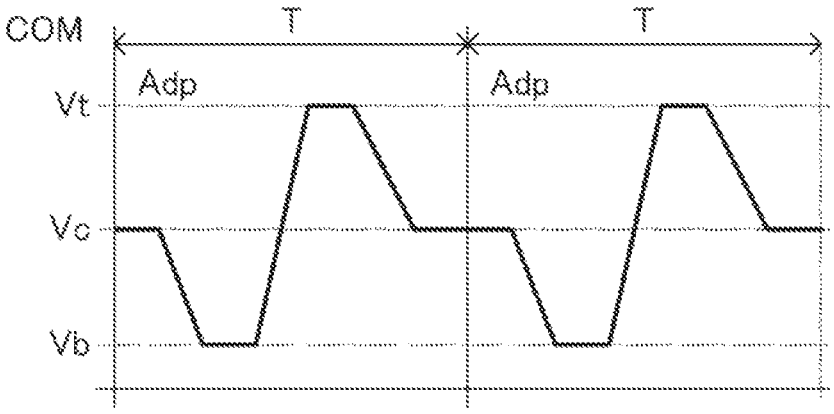
FIG. 6 illustrates an example of the waveform of a driving signal.

Now, an example of the waveform of the driving signal COM output from the driving signal output circuit 50 will be described. FIG. 6 illustrates an example of the waveform of the driving signal COM. As illustrated in FIG. 6, the driving signal COM includes a trapezoidal waveform Adp in each cycle T. The trapezoidal waveform Adp included in this driving signal COM includes: a period constant at a voltage Vc; a period constant at a voltage Vb lower than the voltage Vc, the period following the period constant at the voltage Vc; a period constant at a voltage Vt higher than the voltage Vc, the period following the period constant at the voltage Vb; and a period constant at the voltage Vc, the period following the period constant at the voltage Vt. That is, the driving signal COM includes the trapezoidal waveform Adp that starts at the voltage Vc and terminates at the voltage Vc.

The voltage Vc functions as a reference potential used as a reference in the displacement of the piezoelectric element 60 driven by the driving signal COM. The displacement of the piezoelectric element 60 is kept in a constant state. When the driving signal VOUT based on the driving signal COM including the trapezoidal waveform Adp is supplied to the piezoelectric element 60, the voltage of the driving signal VOUT changes from Vc to Vb. Thus, the piezoelectric element 60 warps upward, for example, expanding the internal volumes of the pressure chambers CB1 and CB2. Therefore, ink is drawn into the pressure chambers CB1 and CB2. After that, when the voltage of the driving signal VOUT changes from Vb to Vt, the piezoelectric element 60 warps downward, contracting the internal volumes of the pressure chambers CB1 and CB2. Therefore, ink held in the pressure chambers CB1 and CB2 is discharged from the nozzle N.

After ink has been discharged from the nozzle N due to the driving of the piezoelectric element 60, the vibration plate 304 or ink in the vicinity of the nozzle N may continue to vibrate for a certain period. The period, included in the driving signal COM, constant at the voltage Vc functions to stop this vibration caused in the vibration plate 304 or ink in the vicinity of the nozzle N. This assures that ink is stably discharged in each cycle T.

4. Structure and Operation of the Driving Signal Selection Circuit

Next, in the liquid discharging apparatus 1 that has the liquid discharge head 22 in which the discharge section 600 has four piezoelectric elements 60 and the four piezoelectric elements 60 are used to discharge ink from a single nozzle N, the structure and operation of the driving signal selection circuit 200 that outputs the driving signal VOUT to be supplied to the piezoelectric element 60 will be described.

Before the structure and operation of the driving signal selection circuit 200 in this embodiment is described, the structure and operation of a driving signal selection circuit 200*a* in a comparative example will be described first with reference to FIG. 7. After that, a problem will be described that may occur when the driving signal selection circuit 200*a* in the comparative example is applied to the liquid discharging apparatus 1 that has the liquid discharge head 22 in which the discharge section 600 has four piezoelectric elements 60 and the four piezoelectric elements 60 are used to discharge ink from a single nozzle N.

Figure 7:
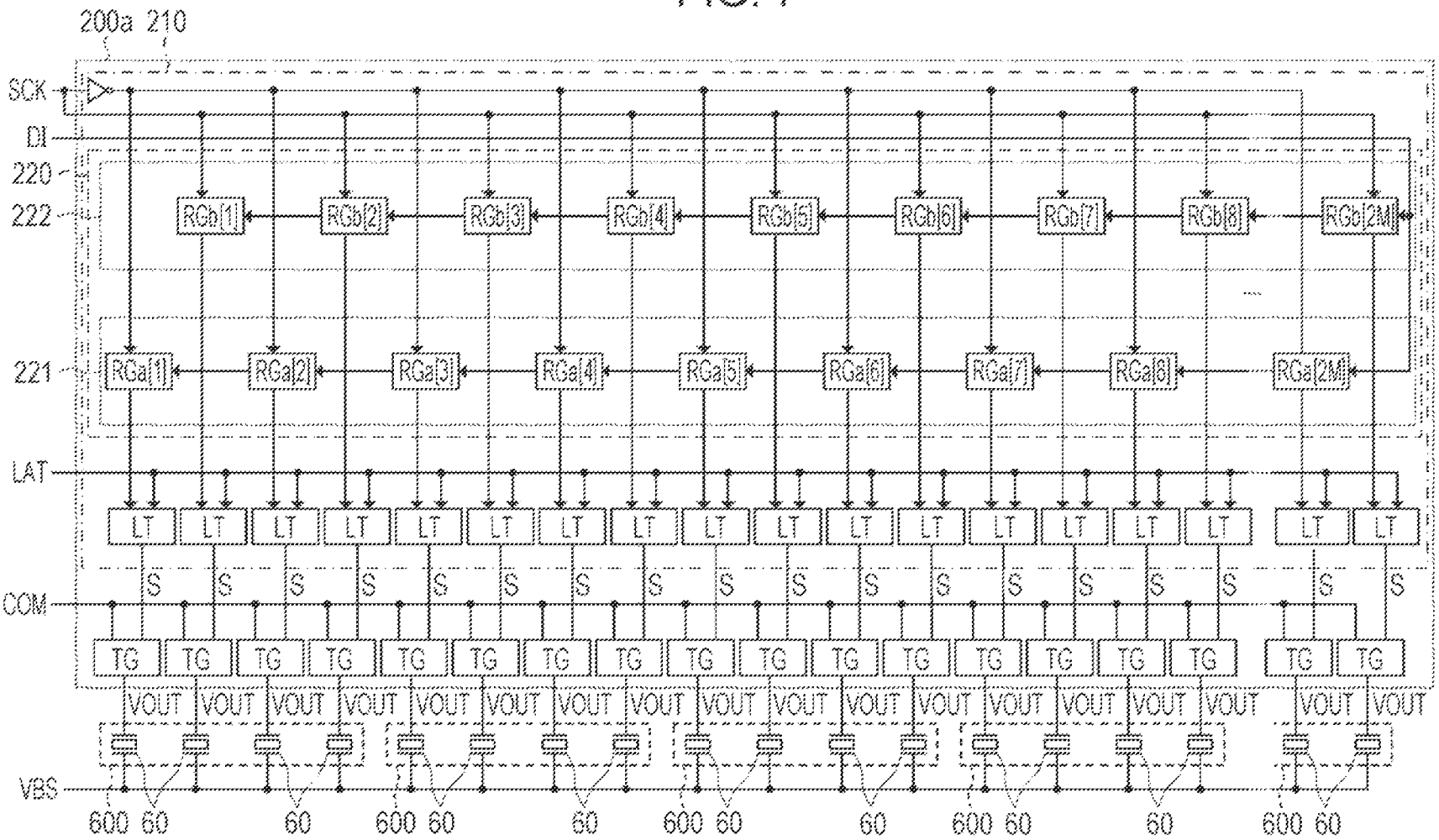
FIG. 7 illustrates the structure of a driving signal selection circuit in a comparative example.

FIG. 7 illustrates the structure of the driving signal selection circuit 200*a* in the comparative example. As illustrated in FIG. 7, the driving signal selection circuit 200*a* has a selection control circuit 210 and 4M selection circuits TG provided in correspondence with the 4M piezoelectric elements 60. In addition, the selection control circuit 210 has a shift register 220 and 4M latch circuits LT corresponding to the 4M selection circuits TG.

The shift register 220 has 4M registers RG corresponding to the 4M piezoelectric elements 60. The shift register 220 transfers discharge data dDI included in the discharge control signal DI that the shift register 220 has received to later registers RG in succession in synchronization with a clock signal SCK. When the supply of the clock signal SCK stops, the shift register 220 holds the discharge data dDI in the registers RG. The discharge data dDI included in the discharge control signal DI is a one-bit data signal that prescribes whether to supply the driving signal COM to the piezoelectric element 60 as the driving signal VOUT. Specifically, the discharge control signal DI serially includes 4M discharge data items dDI, that is, as many discharge data items dDI as there are piezoelectric elements 60 included in the liquid discharge head 22. In other words, the discharge control signal DI is a 4M-bit signal that serially includes 4M discharge data items dDI.

The shift register 220 has a first shift register 221 and a second shift register 222. Of the 4M registers RG, the first shift register 221 has 2M registers RGa[1] to RGa[2M] coupled in series. The first shift register 221 transfers the discharge data dDI included in the discharge control signal DI to the 2M registers RGa[1] to RGa[2M] in succession on a falling edge of the clock signal SCK. When the supply of the clock signal SCK stops, the first shift register 221 holds, in the 2M registers RGa[1] to RGa[2M], the discharge data dDI included in the discharge control signal DI. In the first shift register 221, the 2M registers RGa[1] to RGa[2M] are coupled in series in the order of register RGa[1], register RGa[2], . . . , register RGa[2M], from the downstream toward the upstream in the direction in which the discharge control signal DI is transferred. That is, the discharge data dDI included in the discharge control signal DI is transferred in the order of register RGa[2M], register RGa [2M−1], . . . , register RGa[1], in synchronization with a falling edge of the clock signal SCK.

Of the 4M registers RG, the second shift register 222 has 2M registers RGb[1] to RGb[2M] coupled in series. The second shift register 222 transfers the discharge data dDI included in the discharge control signal DI to the 2M registers RGb[1] to RGb[2M] in succession on a rising edge of the clock signal SCK. When the supply of the clock signal SCK stops, the second shift register 222 holds, in the 2M registers RGb[1] to RGb[2M], the discharge data dDI included in the discharge control signal DI. In the second shift register 222, the 2M registers RGb[1] to RGb[2M] are coupled in series in the order of register RGb[1], register RGb[2], . . . , register RGb[2M], from the downstream toward the upstream in the direction in which the discharge control signal DI is transferred. That is, the discharge data dDI included in the discharge control signal DI is transferred in the order of register RGb[2M], register RGb [2M−1], . . . , register RGb[1], in synchronization with a rising edge of the clock signal SCK.

The 4M latch circuits LT are provided in correspondence with the shift registers RGa[1] to RGa[2M] included in the first shift register 221 and the shift registers RGb[1] to RGb[2M] included in the second shift register 222. The latch circuits LT concurrently latch the 4M discharge data items dDI held in the registers RGa[1] to RGa[2M] included in the first shift register 221 and the registers RGb[1] to RGb[2M] included in the second shift register 222 on a rising edge of the latch signal LAT.

Then, each latch circuit LT outputs the latched discharge data dDI to the relevant selection circuit TG as a selection signal S. The selection circuit TG includes a transfer gate, for example. The selection signal S latched by the latch circuit LT is entered into the control terminal of the transfer gate included in the relevant selection circuit TG. The driving signal COM is supplied to the input terminal of the transfer gate included in the selection circuit TG. When the entered selection signal S is based on data indicating that the driving signal COM is intended to be output as the driving signal VOUT, the selection circuit TG supplies the driving signal COM to the piezoelectric element 60 as the driving signal VOUT. When the entered selection signal S is based on data indicating that the driving signal COM is intended not to be output as the driving signal VOUT, the selection circuit TG does not supply the driving signal COM to the piezoelectric element 60 as the driving signal VOUT.

With the driving signal selection circuit 200*a*, structured as described above, in the comparative example, even when one discharge section 600 has four piezoelectric elements 60 and ink is discharged from a single nozzle, the discharge control signal DI including discharge data dDI corresponding to the four piezoelectric elements 60 needs to be propagated in the shift register 220. This makes it hard to shorten the data length of the discharge control signal DI and thereby makes it hard to increase the propagation speed of the discharge control signal DI. In general, driving signals VOUT having similar signal waveforms are supplied to the four piezoelectric elements 60 included in one discharge section 600. Therefore, although the driving signal COM to drive the four piezoelectric elements 60 can also be output from one selection circuit TG included in the driving signal selection circuit 200*a*, this increases a current flowing in the selection circuit TG, resulting in a demand for a large selection circuit TG. This makes it hard to downsize the integrated circuit 201 in which the driving signal selection circuit 200*a* is mounted.

The driving signal selection circuit 200 in this embodiment addresses the above problem. With the driving signal selection circuit 200, it is possible to increase the propagation speed of the discharge control signal DI and to enhance the versatility of the driving signal selection circuit 200 without hindering the downsizing of the integrated circuit 201 in which the driving signal selection circuit 200 is mounted.

Figure 8:
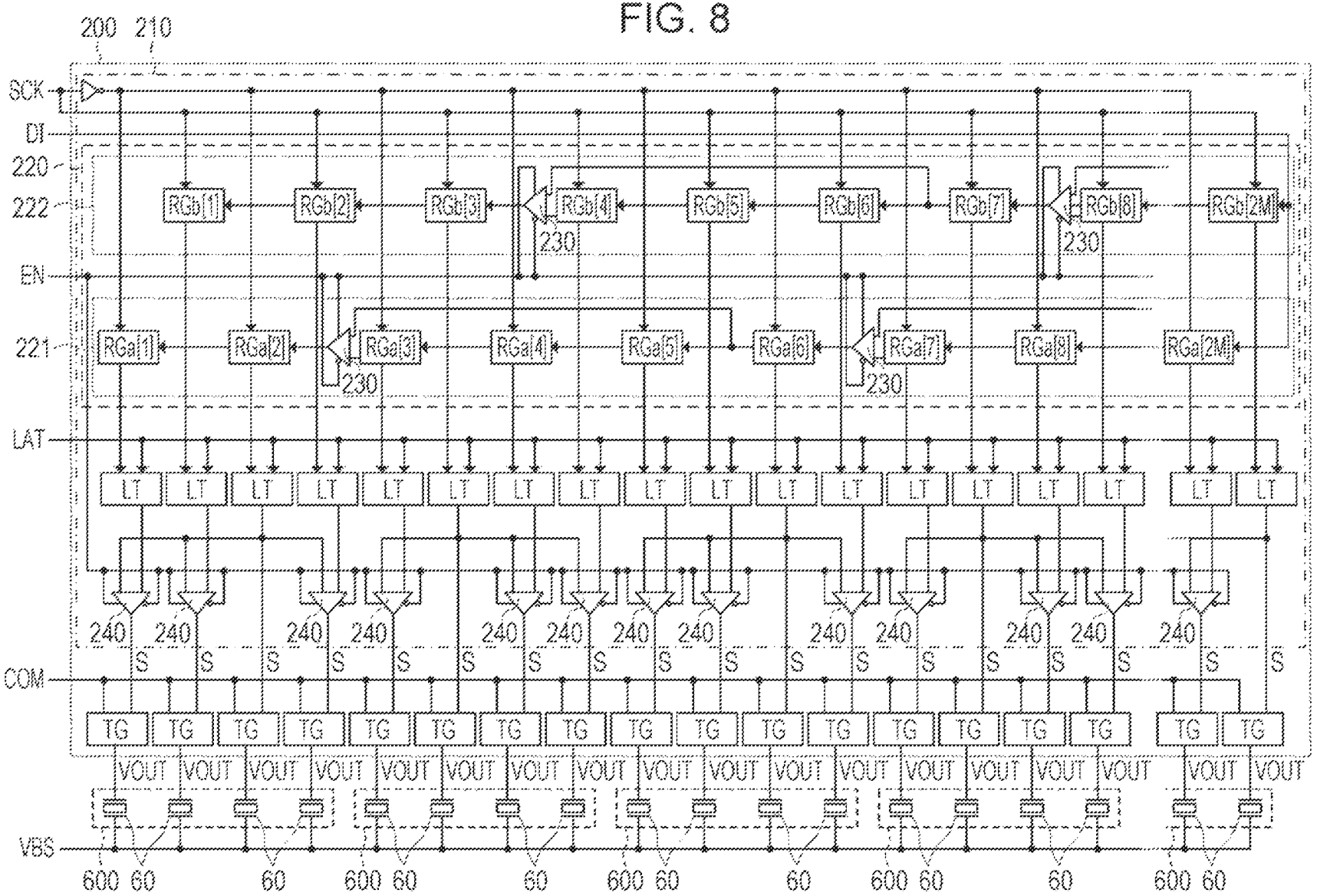
FIG. 8 illustrates the structure of a driving signal selection circuit in an embodiment of the present disclosure.

FIG. 8 illustrates the structure of the driving signal selection circuit 200 in this embodiment. In the description of the driving signal selection circuit 200 in this embodiment, elements similar to those in the driving signal selection circuit 200*a* in the comparative example in FIG. 7 will be denoted by identical reference characters and their descriptions will be omitted.

As illustrated in FIG. 8, the driving signal selection circuit 200 in this embodiment has three switching circuits 240 for each discharge section 600. These switching circuits 240 are coupled to the outputs of three latch circuits LT of the four latch circuits LT corresponding to the four piezoelectric elements 60 included in the discharge section 600, and are also coupled to selection circuits TG corresponding to the three latch circuits LT.

Specifically, one input terminal of each of the three switching circuits 240 is coupled to the output of the relevant latch circuit LT; another input terminal of each of the three switching circuits 240 is coupled to the output of the latch circuit LT that is not coupled to any switching circuit 240, the latch circuit LT being the remaining one of the four latch circuits LT; and the output terminals of the three switching circuits 240 are coupled to the relevant selection circuits TG. The switching signal SW is entered into the control terminal of each of the three switching circuits 240.

Each of the three switching circuits 240 structured as described above switches the selection signal S to be entered into the relevant selection circuit TG between the selection signal S output from the corresponding latch circuit LT and entered into one input terminal of the switching circuit 240 and the selection signal S output from the latch circuit LT that is not coupled to any switching circuit 240 and entered into the other input terminal of the switching circuit 240, according to the logical level of the switching signal SW entered into the control terminal of the switching circuit 240.

That is, the three switching circuits 240 switch so that the selection signal S output from the latch circuit LT that is not coupled to any switching circuit 240, the latch circuit LT being one of the latch circuits LT corresponding to the four piezoelectric elements 60 included in the same discharge section 600, is entered into the relevant selection circuit TG or that the selection signal S output from each of the four latch circuits LT is entered into the relevant selection circuit TG. That is, the driving signal selection circuit 200 in this embodiment has two modes. In one mode, according to the selection signal S output from the latch circuit LT that is not coupled to any switching circuit 240, the latch circuit LT being one of the four latch circuits LT corresponding to the four piezoelectric elements 60 included in the same discharge section 600, the driving signal selection circuit 200 controls the four selection circuits TG corresponding to the four latch circuits LT in common. In the other mode, according to the selection signal S output from each of the four latch circuits LT corresponding to the four piezoelectric elements 60 included in the same discharge section 600, the driving signal selection circuit 200 controls the relevant selection circuit TG. Thus, the driving signal selection circuit 200 can control the four selection circuits TG corresponding to the four piezoelectric elements 60 included in the same discharge section 600, according to the selection signal S output from one latch circuit LT.

In the driving signal selection circuit 200 in this embodiment, the shift register 220 has a plurality of switching circuits 230, as illustrated in FIG. 8.

Specifically, some of the plurality of switching circuits 230 are coupled in series with the 2M registers RGa[1] to RGa[2M] included in the first shift register 221 in the shift register 220. More specifically, between the registers RGa[2] and RGa[3] of the 2M registers RGa[1] to RGa[2M], one of the plurality of switching circuits 230 is coupled so that one of the input terminals of the switching circuit 230 is coupled to the output of the register RGa[3], the other input terminal is coupled to the output of the register RGa[6], and the output terminal of the switching circuit 230 is coupled to the register RGa[2]. Between the registers RGa[6] and RGa[7] of the 2M registers RGa[1] to RGa[2M], another of the plurality of switching circuit 230 is coupled so that one of the input terminals of the switching circuit 230 is coupled to the output of the register RGa[7], the other input terminal is coupled to the output of the register RGa[10], and the output terminal of the switching circuit 230 is coupled to the register RGa[6]. That is, in the first shift register 221 included in the shift register 220, between registers RGa[2+r] (r is 0 or a multiple of 4 from 1 to 2M−2) and RGa[3+r] of the 2M registers RGa[1] to RGa[2M], each of the plurality of switching circuits 230 is coupled so that one of the input terminals of the switching circuit 230 is coupled to the output of the register RGa[3+r], the other input terminal is coupled to the output of the register RGa[6+r], and the output terminal of the switching circuit 230 is coupled to the register RGa[2+r].

Some of the plurality of switching circuits 230 are coupled in series with the 2M registers RGb[1] to RGb[2M] included in the second shift register 222 in the shift register 220. Specifically, between the registers RGb[3] and RGb[4] of the 2M registers RGb[1] to RGb[2M], one of the plurality of switching circuits 230 is coupled so that one of the input terminals of the switching circuit 230 is coupled to the output of the register RGb[4], the other input terminal is coupled to the output of the register RGb[7], and the output terminal of the switching circuit 230 is coupled to the register RGb[3]. Between the registers RGb[7] and RGb[8] of the 2M registers RGb[1] to RGb[2M], another of the plurality of switching circuit 230 is coupled so that one of the input terminals of the switching circuit 230 is coupled to the output of the register RGb[8], the other input terminal is coupled to the output of the register RGb[11], and the output terminal of the switching circuit 230 is coupled to the register RGb[7]. That is, in the second shift register 222 included in the shift register 220, between registers RGb[3+s] (s is 0 or a multiple of 4 from 1 to 2M−2) and RGb[4+s] of the 2M registers RGb[1] to RGb[2M], each of the plurality of switching circuits 230 is coupled so that one of the input terminals of the switching circuit 230 is coupled to the output of the register RGb[4+s], the other input terminal is coupled to the output of the register RGb[7+s], and the output terminal of the switching circuit 230 is coupled to the register RGb[3+s].

In the first shift register 221, the plurality of switching circuits 230 included in the shift register 220 structured as described above can thin out some registers RGa from the 2M registers RGa[1] to RGa[2M] coupled in series. In the second shift register 222, the plurality of switching circuits 230 can also thin out some registers RGb from the 2M registers RGb[1] to RGb[2M] coupled in series.

Each register RG to be thinned out by the plurality of switching circuits 230 is set so as to correspond to the latch circuit LT from which the selection signal S, which is output from the latch circuit LT, is not supplied to the relevant selection circuit TG by the switching circuit 240. Thus, discharge data dDI corresponding to the latch circuit LT can be eliminated from the discharge control signal DI. As a result, the data length of the discharge control signal DI can be shortened.

In this embodiment, the plurality of switching circuits 240 and the plurality of switching circuits 230 are switched by a common switching signal SW. This reduces the risk that an inconsistency occurs in the driving signal selection circuit 200 between the states of the plurality of switching circuits 240 and the states of the plurality of switching circuits 230, improving stability in the operation of the driving signal selection circuit 200.

Any one of the three switching circuits 240, each of which is coupled to the output of any one of three latch circuits LT of the four latch circuits LT corresponding to the four piezoelectric elements 60 included in the same discharge section 600 and is also coupled to the selection circuit TG corresponding to the latch circuit LT, is an example of a fifth switch. Another of the three switching circuits 240 is an example of a sixth switch. The other of the three switching circuits 240 is an example of a seventh switch. The discharge data dDI on which the selection signal S to be output from the switching circuit 240 equivalent to the fifth switch is based is an example of second data. The discharge data dDI on which the selection signal S to be output from the switching circuit 240 equivalent to the sixth switch is based is an example of third data. The discharge data dDI on which the selection signal S to be output from the switching circuit 240 equivalent to the seventh switch is based is an example of fourth data. The discharge data dDI entered into the switching circuit 240 equivalent to the fifth switch, the switching circuit 240 equivalent to the sixth switch, and the switching circuit 240 equivalent to the seventh switch in common, the selection signal S being based on the discharge data dDI, is an example of first data. The control circuit 100 that outputs the discharge control signal DI including the discharge data dDI equivalent to the first data, the discharge data dDI equivalent to the second data, the discharge data dDI equivalent to the third data, and the discharge data dDI equivalent to the fourth data is an example of a discharge control signal output circuit. The driving signal selection circuit 200 is an example of a switch control circuit. The selection circuit TG that operates in response to the selection signal S output from the latch circuit LT that latches the discharge data dDI equivalent to the first data is an example of a first switch circuit. The selection circuit TG that operates in response to the selection signal S output from the switching circuit 240 equivalent to the fifth switch is an example of a second switch circuit. The selection circuit TG that operates in response to the selection signal S output from the switching circuit 240 equivalent to the sixth switch is an example of a third switch circuit. The selection circuit TG that operates in response to the selection signal S output from the switching circuit 240 equivalent to the seventh switch is an example of a fourth switch circuit. The piezoelectric element 60 to which the driving signal VOUT output from the selection circuit TG equivalent to the first switch is an example of a first piezoelectric element. The piezoelectric element 60 to which the driving signal VOUT output from the selection circuit TG equivalent to the second switch is an example of a second piezoelectric element. The piezoelectric element 60 to which the driving signal VOUT output from the selection circuit TG equivalent to the third switch is an example of a third piezoelectric element. The piezoelectric element 60 to which the driving signal VOUT output from the selection circuit TG equivalent to the fourth switch is an example of a fourth piezoelectric element. The pressure chamber CB1 or CB2 in which pressure changes due to the driving of the piezoelectric element 60 equivalent to the first piezoelectric element is an example of a first pressure chamber. The pressure chamber CB1 or CB2 in which pressure changes due to the driving of the piezoelectric element 60 equivalent to the second piezoelectric element is an example of a second pressure chamber. The pressure chamber CB1 or CB2 in which pressure changes due to the driving of the piezoelectric element 60 equivalent to the third piezoelectric element is an example of a third pressure chamber. The pressure chamber CB1 or CB2 in which pressure changes due to the driving of the piezoelectric element 60 equivalent to the fourth piezoelectric element is an example of a fourth pressure chamber. A mode in which according to the selection signal S output from the latch circuit LT that is not coupled to any switching circuit 240, the latch circuit LT being one of the four latch circuits LT corresponding to the four piezoelectric elements 60 included in the same discharge section 600, the four selection circuits TG corresponding to the four latch circuits LT are controlled in common is an example of a first mode. Another mode in which, according to the selection signal S output from each of the four latch circuits LT corresponding to the four piezoelectric elements 60 included in the same discharge section 600, the relevant selection circuit TG is controlled is an example of a second mode. The switching signal SW that switches the driving signal selection circuit 200 between the first mode and the second mode is an example of a switching control signal.

5. Effects

In the liquid discharging apparatus 1 structured as described above in this embodiment, the driving signal selection circuit 200 included in the liquid discharge head 22 controls four selection circuits TG corresponding to four piezoelectric element piezoelectric elements 60 included in the same discharge section 600 according to a selection signal S output from one latch circuit LT. This makes it possible to reduce discharge data dDI, included in the discharge control signal DI, that controls the selection circuits TG. As a result, the data length of the discharge control signal DI can be shortened. When the data length of the discharge control signal DI is shortened, the propagation speed of the discharge control signal DI is increased.

In the liquid discharging apparatus 1 in this embodiment, the driving signal selection circuit 200 has: a mode in which according to the selection signal S output from another latch circuit LT of the latch circuits LT corresponding to the four piezoelectric elements 60 included in the same discharge section 600, the selection circuit TG corresponding to one latch circuit LT and the selection circuit TG corresponding to the other latch circuit LT are controlled; and another mode in which according to the selection signal S output from the one latch circuit LT of the latch circuits LT corresponding to the two piezoelectric elements 60 included in the same discharge section 600, the selection circuit TG corresponding to the one latch circuit LT is controlled, and according to the selection signal S output from the other latch circuit LT, the selection circuit TG corresponding to the other latch circuit LT are controlled. Thus, the driving signal selection circuit 200 can switch its operation according to whether one piezoelectric element 60 or four piezoelectric elements 60 are included in the same discharge section 600. This can enhance the versatility of the driving signal selection circuit 200.

So far, an embodiment has been described. However, the present disclosure is not limited to this embodiment. The present disclosure can be practiced in various aspects without departing from the intended scope of the present disclosure. For example, the above embodiment can be appropriately combined.

The present disclosure includes substantially the same structure as a structure described in the embodiment, the same structure being, for example, a structure having the same function, method and result or the same object and effects as described in the embodiment. The present disclosure also includes a structure in which a portion that is not essential to a structure described in the embodiment is replaced. The present disclosure also includes a structure that has the same effects as the effects of a structure described in the embodiment or a structure that can achieve the same object as the object of a structure described in the embodiment. The present disclosure also includes a structure in which a known technology is added to a structure described in the embodiment.

The following can be derived from the embodiment described above.

A liquid discharging apparatus in one aspect has: a driving signal output circuit that outputs a driving signal; a discharge control signal output circuit that outputs a discharge control signal including first data, second data, third data, and fourth data; and a liquid discharge head that discharges a liquid in response to the driving signal and the discharge control signal. The liquid discharge head has: a first driving element, a second driving element, a third driving element, and a fourth driving element that are driven by the driving signal; and an integrated circuit that controls supply of the driving signal to the first driving element, to the second driving element, to the third driving element, and to the fourth driving element according to the discharge control signal. The integrated circuit has: a first switch circuit that receives the driving signal and switches between output and non-output of the driving signal to the first driving element; a second switch circuit that receives the driving signal and switches between output and non-output of the driving signal to the second driving element; a third switch circuit that receives the driving signal and switches between output and non-output of the driving signal to the third driving element; a fourth switch circuit that receives the driving signal and switches between output and non-output of the driving signal to the fourth driving element; and a switch control circuit that receives the discharge control signal and controls whether to cause each of the first switch circuit, the second switch circuit, the third switch circuit, and the fourth switch circuit to output the driving signal. The switch control circuit has: a fifth switch circuit that receives the first data and the second data; a sixth switch circuit that receives the first data and the third data; and a seventh switch circuit that receives the first data and the fourth data. The fifth switch circuit switches between output of the first data to the second switch circuit and output of the second data to the second switch circuit. The sixth switch circuit switches between output of the first data to the third switch circuit and output of the third data to the third switch circuit. The seventh switch circuit switches between output of the first data to the fourth switch circuit and output of the fourth data to the fourth switch circuit.

With this liquid discharging apparatus, a plurality of switches including a first switch, a second switch, a third switch, and a fourth switch can be operated according to a single data item. This makes it possible to reduce the amount of data included in the discharge control signal. As a result, the communication speed of the discharge control signal can be increased.

In the liquid discharging apparatus in the one aspect, the switch control circuit may have: a first mode in which the switch control circuit controls the first switch circuit, the second switch circuit, the third switch circuit, and the fourth switch circuit according to the first data; and a second mode in which the switch control circuit controls the first switch circuit according to the first data, controls the second switch circuit according to the second data, controls the third switch circuit according to the third data, and controls the fourth switch circuit according to the fourth data.

With this liquid discharging apparatus, a plurality of switches including a first switch, a second switch, a third switch, and a fourth switch can be operated according to a single data item. This makes it possible to reduce the amount of data included in the discharge control signal. As a result, the communication speed of the discharge control signal can be increased.

In the liquid discharging apparatus in the one aspect, switching may be made between the first mode and the second mode according to a switching control signal entered into the integrated circuit.

In the liquid discharging apparatus in the one aspect, the liquid discharge head may have: a first pressure chamber in which pressure changes due to driving of the first driving element; a second pressure chamber in which pressure changes due to driving of the second driving element; a third pressure chamber in which pressure changes due to driving of the third driving element; a fourth pressure chamber in which pressure changes due to driving of the fourth driving element; and a nozzle from which a liquid is discharged, the nozzle communicating with the first pressure chamber, the second pressure chamber, the third pressure chamber, and the fourth pressure chamber.

With this liquid discharging apparatus, a highly viscous liquid can be used, further enhancing the versatility of the liquid discharging apparatus.

An integrated circuit device in one aspect is provided in a liquid discharge head that has a first driving element, a second driving element, a third driving element, and a fourth driving element; the integrated circuit device has: a first switch circuit that receives a driving signal and switches between output and non-output of the driving signal to the first driving element; a second switch circuit that receives the driving signal and switches between output and non-output of the driving signal to the second driving element; a third switch circuit that receives the driving signal and switches between output and non-output of the driving signal to the third driving element; a fourth switch circuit that receives the driving signal and switches between output and non-output of the driving signal to the fourth driving element; and a switch control circuit that receives a discharge control signal and controls whether to cause each of the first switch circuit, the second switch circuit, the third switch circuit, and the fourth switch circuit to output the driving signal. The switch control circuit has: a fifth switch circuit that receives the first data and the second data; a sixth switch circuit that receives the first data and the third data; and a seventh switch circuit that receives the first data and the fourth data. The fifth switch circuit switches between output of the first data to the second switch circuit and output of the second data to the second switch circuit. The sixth switch circuit switches between output of the first data to the third switch circuit and output of the third data to the third switch circuit. The seventh switch circuit switches between output of the first data to the fourth switch circuit and output of the fourth data to the fourth switch circuit.

With this integrated circuit device, a plurality of switches including a first switch, a second switch, a third switch, and a fourth switch can be operated according to a single data item. This makes it possible to reduce the amount of data included in the discharge control signal. As a result, the communication speed of the discharge control signal can be increased.

What is claimed is:

1. A liquid discharging apparatus comprising:

a driving signal output circuit that outputs a driving signal;

a discharge control signal output circuit that outputs a discharge control signal including first data, second data, third data, and fourth data; and a liquid discharge head that discharges a liquid in response to the driving signal and the discharge control signal; wherein the liquid discharge head has a first driving element, a second driving element, a third driving element, and a fourth driving element that are driven by the driving signal, and an integrated circuit that controls supply of the driving signal to the first driving element, to the second driving element, to the third driving element, and to the fourth driving element according to the discharge control signal, the integrated circuit has a first switch circuit that receives the driving signal and switches between output and non-output of the driving signal to the first driving element, a second switch circuit that receives the driving signal and switches between output and non-output of the driving signal to the second driving element, a third switch circuit that receives the driving signal and switches between output and non-output of the driving signal to the third driving element, a fourth switch circuit that receives the driving signal and switches between output and non-output of the driving signal to the fourth driving element, and a switch control circuit that receives the discharge control signal and controls whether to cause each of the first switch circuit, the second switch circuit, the third switch circuit, and the fourth switch circuit to output the driving signal, the switch control circuit has a fifth switch circuit that receives the first data and the second data, a sixth switch circuit that receives the first data and the third data, and a seventh switch circuit that receives the first data and the fourth data, the fifth switch circuit switches between output of the first data to the second switch circuit and output of the second data to the second switch circuit, the sixth switch circuit switches between output of the first data to the third switch circuit and output of the third data to the third switch circuit, and the seventh switch circuit switches between output of the first data to the fourth switch circuit and output of the fourth data to the fourth switch circuit.

2. The liquid discharging apparatus according to claim 1, wherein the switch control circuit has:

a first mode in which the switch control circuit controls the first switch circuit, the second switch circuit, the third switch circuit, and the fourth switch circuit according to the first data; and a second mode in which the switch control circuit controls the first switch circuit according to the first data, controls the second switch circuit according to the second data, controls the third switch circuit according to the third data, and controls the fourth switch circuit according to the fourth data.

3. The liquid discharging apparatus according to claim 2, wherein switching is made between the first mode and the second mode according to a switching control signal entered into the integrated circuit.

4. The liquid discharging apparatus according to claim 1, wherein the liquid discharge head has:

a first pressure chamber in which pressure changes due to driving of the first driving element;

a second pressure chamber in which pressure changes due to driving of the second driving element;

a third pressure chamber in which pressure changes due to driving of the third driving element;

a fourth pressure chamber in which pressure changes due to driving of the fourth driving element; and a nozzle from which a liquid is discharged, the nozzle communicating with the first pressure chamber, the second pressure chamber, the third pressure chamber, and the fourth pressure chamber.

5. An integrated circuit device provided in a liquid discharge head that has a first driving element, a second driving element, a third driving element, and a fourth driving element, the integrated circuit device comprising:

a first switch circuit that receives a driving signal and switches between output and non-output of the driving signal to the first driving element;

a second switch circuit that receives the driving signal and switches between output and non-output of the driving signal to the second driving element;

a third switch circuit that receives the driving signal and switches between output and non-output of the driving signal to the third driving element;

a fourth switch circuit that receives the driving signal and switches between output and non-output of the driving signal to the fourth driving element; and a switch control circuit that receives a discharge control signal and controls whether to cause each of the first switch circuit, the second switch circuit, the third switch circuit, and the fourth switch circuit to output the driving signal; wherein the switch control circuit has a fifth switch circuit that receives the first data and the second data, a sixth switch circuit that receives the first data and the third data, and a seventh switch circuit that receives the first data and the fourth data, the fifth switch circuit switches between output of the first data to the second switch circuit and output of the second data to the second switch circuit, the sixth switch circuit switches between output of the first data to the third switch circuit and output of the third data to the third switch circuit, and the seventh switch circuit switches between output of the first data to the fourth switch circuit and output of the fourth data to the fourth switch circuit.

* * * * *